US009630220B2

(12) United States Patent
Kuan

(10) Patent No.: US 9,630,220 B2
(45) Date of Patent: Apr. 25, 2017

(54) AIR-WIPING DEVICE OPENING AND CLOSING IN ONE LEVEL PLANE

(71) Applicants: Juin-Ping Kuan, New Taipei (TW); Chun-Kuang Kuan, New Taipei (TW); Bruce Kuan, New Taipei (TW)

(72) Inventor: Chuang-Tao Kuan, New Taipei (TW)

(73) Assignees: Juin-Ping Kuan, New Taipei (TW); Chun-Kuang Kuan, New Taipei (TW); Bruce Kuan, New Taipei (TW)

( * ) Notice: Subject to any disclaimer, the term of this patent is extended or adjusted under 35 U.S.C. 154(b) by 364 days.

(21) Appl. No.: 14/323,905

(22) Filed: Jul. 3, 2014

(65) Prior Publication Data

US 2015/0013105 A1 Jan. 15, 2015

Related U.S. Application Data

(60) Provisional application No. 61/843,197, filed on Jul. 5, 2013.

(51) Int. Cl.

| | |
|---|---|
| ***B08B 5/02*** | (2006.01) |
| ***F26B 13/10*** | (2006.01) |
| ***F26B 13/24*** | (2006.01) |
| *B21B 45/02* | (2006.01) |

(52) U.S. Cl.

CPC ..... *B08B 5/023* (2013.01); *F26B 13/108* (2013.01); *F26B 13/24* (2013.01); *B21B 45/0278* (2013.01)

(58) Field of Classification Search

CPC ... B08B 5/02; B08B 5/04; B43L 21/02; H01L 21/67028; H01L 21/67051; F26B 13/108; F26B 13/24

See application file for complete search history.

(56) References Cited

U.S. PATENT DOCUMENTS

| | | | | |
|---|---|---|---|---|
| 3,270,364 | A * | 9/1966 | Steele | B21B 45/0278 118/63 |
| 3,736,618 | A * | 6/1973 | Ramsey | D07B 7/12 134/64 R |
| 4,033,785 | A * | 7/1977 | Gibbs | B08B 3/022 134/122 R |
| 8,336,161 | B1 * | 12/2012 | Bettencourt | F26B 13/001 15/309.1 |

* cited by examiner

*Primary Examiner* — Robert Scruggs
(74) *Attorney, Agent, or Firm* — Muncy, Geissler, Olds & Lowe, P.C.

(57) ABSTRACT

An air-wiping device for removing particulates, including water, adhering to an elongated member by compressed air is provided. In particular, this invention relates to an air-wiping device that loads said elongated member by opening with a sliding motion in one plane, instead of swinging open in two planes that is commonly to the conventional air-wiping devices embodied in a clamshell configuration, which not only substantially shortens the loading time but also greatly reduces the floor space needed to accommodate said device.

3 Claims, 4 Drawing Sheets

AIR-WIPING DEVICE OPENING AND CLOSING IN ONE LEVEL PLANE

CROSS REFERENCE TO RELATED APPLICATIONS

This application claims priority of U.S. Provisional Application No. 61/843,197 filed on Jul. 5, 2013 under 35 U.S.C. §119(e), the entire contents of all of which are hereby incorporated by reference.

BACKGROUND OF THE DISCLOSURE

1. Field of the Disclosure

The present invention relates to an air-wiping device for dislodging particulates adhering to an elongated member by compressed air. This invention further relates to an air-wiping device, which allows the loading of said elongated member in one level sliding motion, which not only substantially reduces the loading time but also greatly saves the space normally taken up by the hinged, split open clamshell air-wiping devices.

2. Background

In the manufacturing of elongated products, such as the electrical wire, it is usually necessary to remove liquids from the surface of the wire, such as the wire emerging from a rinsing tank after pickling. This can best be done by compressed air which, when decompressed into a cylindrical device known as an air wipe with orifices directing the air tangentially and opposite to the wire movement, converts the potential energy of the compressed air into kinetic energy to blow away the liquid.

In this respect, the efficiency of the air-wiping device is of prime concern. The most efficient air-wiping device is the one configured in a one-piece cylinder having an inlet end and an outlet end for respectively receiving and passing the elongated product. This one-piece cylinder, which is configured in one integral tube, precludes any leakage that is detrimental to the efficiency of the device.

On the other hand, a one-piece cylindrical air-wiping device necessitates the temporarily stoppage of the elongated product in motion when loading it into the said air-wiping device, which adds to machine downtime. Therefore, hinged, split open clamshell air-wiping devices are created to allow loading without stoppage of the elongated product in motion.

These hinged, split open air-wiping device needs to swing open its top lid to load the elongated member in motion then reverse swing to close and wipe. These operations take time. The very need to load and unload by swinging the lid takes up otherwise space.

SUMMARY

It is an object of the present invention to provide an air-wiping device eliminating the swinging motion, shortening the load time, and saving space.

It is another object of the present invention to provide an air-wiping device having decreased frictional abrasion on the wiping passage and having extended service life.

To achieve the advantages of the invention, and in accordance with the purpose of this invention, as embodied and described herein, the invention comprises the following:

An air-wiping device that preferably has a rectangular metallic housing for dislodging adhering particulates from a traversing elongated member is provided. Said metallic housing includes a wiping passage with at least one orifice for directing compressed air tangentially and opposite to the direction of the traversing elongated member, an inlet end for receiving the elongated member into the wiping cylinder and an outlet end for allowing the elongated member to leave the said passage.

The metallic housing consists of two half bodies/pieces each fitted at its longitudinal center one-half piece of a cylindrical wiping passage made of wear-resistance material, and is provided to direct the compressed air tangentially to the center line of said cylinder. Two precisely machined rails passing through holes which have been machined normal to the longitudinal center and lapped on the two half bodies/pieces of the metallic housing allow the air-wiping device to open and close in one level plane without pitching or yawing, thus assuring a perfect hermetic sealing of said two half bodies/pieces and the cylindrical wiping passage thereof when said device is in the closed, wiping status.

Said wear-resistant cylindrical wiping passage is preferably fabricated from sintered aluminum oxide, boron carbide, ruby, sapphire, silicon carbide, silicon nitride, tungsten carbide, tetragonal Zirconia crystalline or any other material, which is resistant to frictional abrasion.

To reduce friction, said wear-resistant cylindrical wiping passage is preferably diamond polished in the interior surface to a roughness of less than 0.4 microns Rz.

The metallic housing is preferably fabricated from non-magnetic metal, which can be aluminum, brass, and austenitic stainless steel then electroless nickel-plated to impart a wear-resistant and self-lubricating coating. The choice of a metallic instead of an elastomer material for the housing allows precision machining of the housing to achieve the desired hermetic sealing. Furthermore, the choice of the metallic housing plus the ceramic cylindrical wiping passage provides a dependable, inflexible support for the air-wiping device when it becomes necessary to expose the air-wiping device to elevated temperatures, which may ruin elastomer housing.

A tension spring and the environmental atmospheric pressure keep the metallic housing, including the cylindrical wiping passage, hermetically sealed when the device is closed under wiping yet it will open readily to let pass knots present on the elongated member.

Each brass air inlet coupling attached and hermetically sealed to the metallic housing lets in the compressed air into the cylindrical wiping passage. These bronze air inlet couplings, connected to and together with metallic compressed air delivery pipes in unison with the ceramic cylindrical wire passage, are allowed to be exposed to elevated temperatures of the said air-wiping device.

DETAILED DESCRIPTION

Reference is now made to the present preferred embodiment of the present invention, which is illustrated in the accompanying drawings.

The metallic housing consists of two half bodies/pieces each fitted at its longitudinal center one-half piece of a cylindrical wiping passage made of wear-resistance material, and have at least one orifice to direct the compressed air tangentially to the center line of said cylinder. Said wear-resistant cylindrical wiping passage is preferably fabricated from sintered aluminum oxide, boron carbide, ruby, sapphire, silicon carbide, silicon nitride, tungsten carbide, tetragonal Zirconia crystalline or any other material, which is resistant to frictional abrasion. To reduce friction, said wear-resistant cylindrical wiping passage is preferably diamond polished in the interior surface to a roughness of less than 0.4 microns Rz.

In addition, at least two precisely machined rails passing through the two half bodies/pieces of the metallic housing is provided. The rails allow the bodies/pieces of the air-wiping device to open and close in one level plane without pitching or yawing, thus assuring a leak-proof hermetic sealing of said two half pieces cylindrical passage when the air-wiping device is closed. Said rails are preferably cylindrical and rotary. Furthermore, said rails bear against the traversing elongated member, relieving a major portion of the frictional abrasion, which otherwise exerts on the wiping passage, extending the service life of the air-wiping device.

Figure 1:
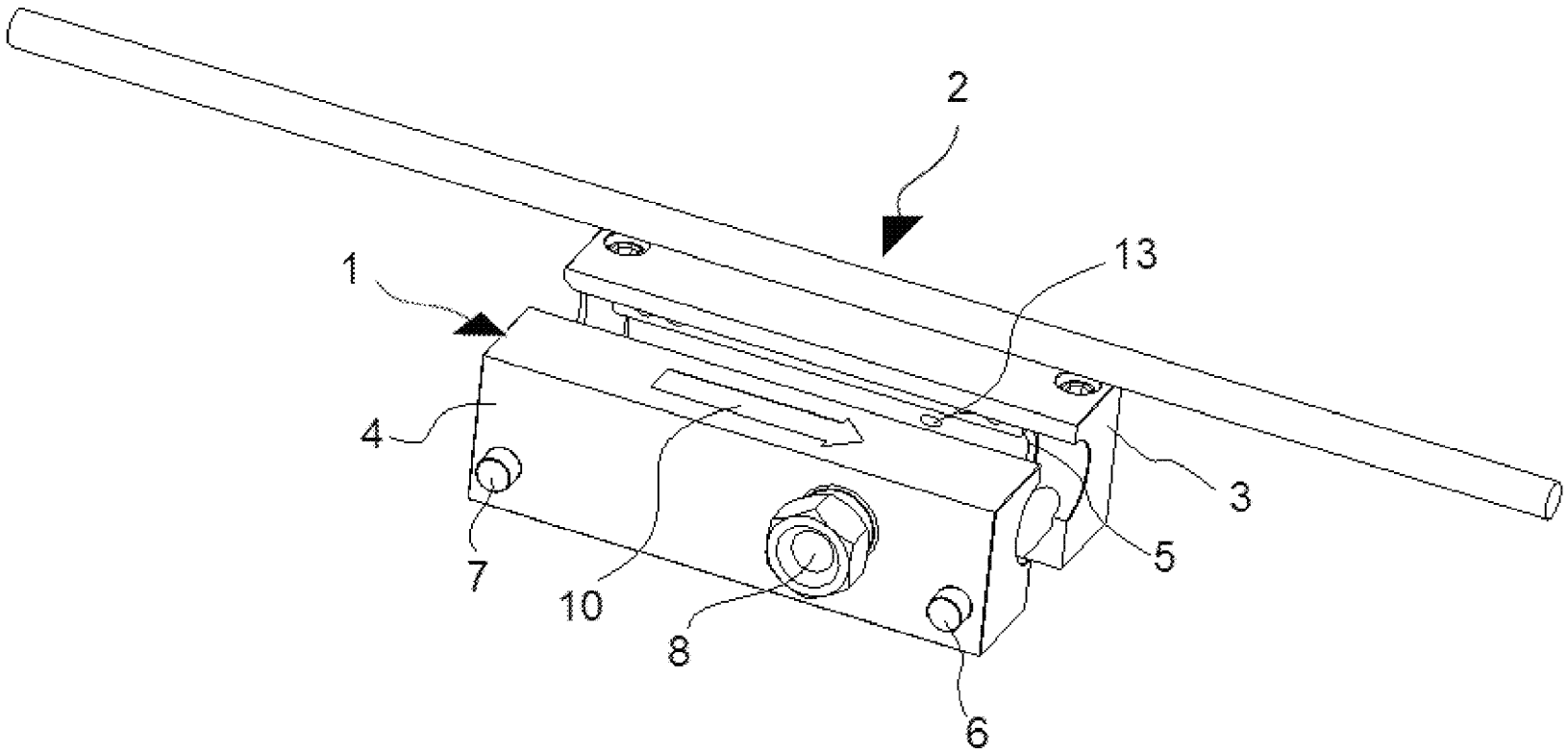
FIG. 1 is a perspective view of the air-wiping device in the opening status to receiving an elongated member.
Figure 2:
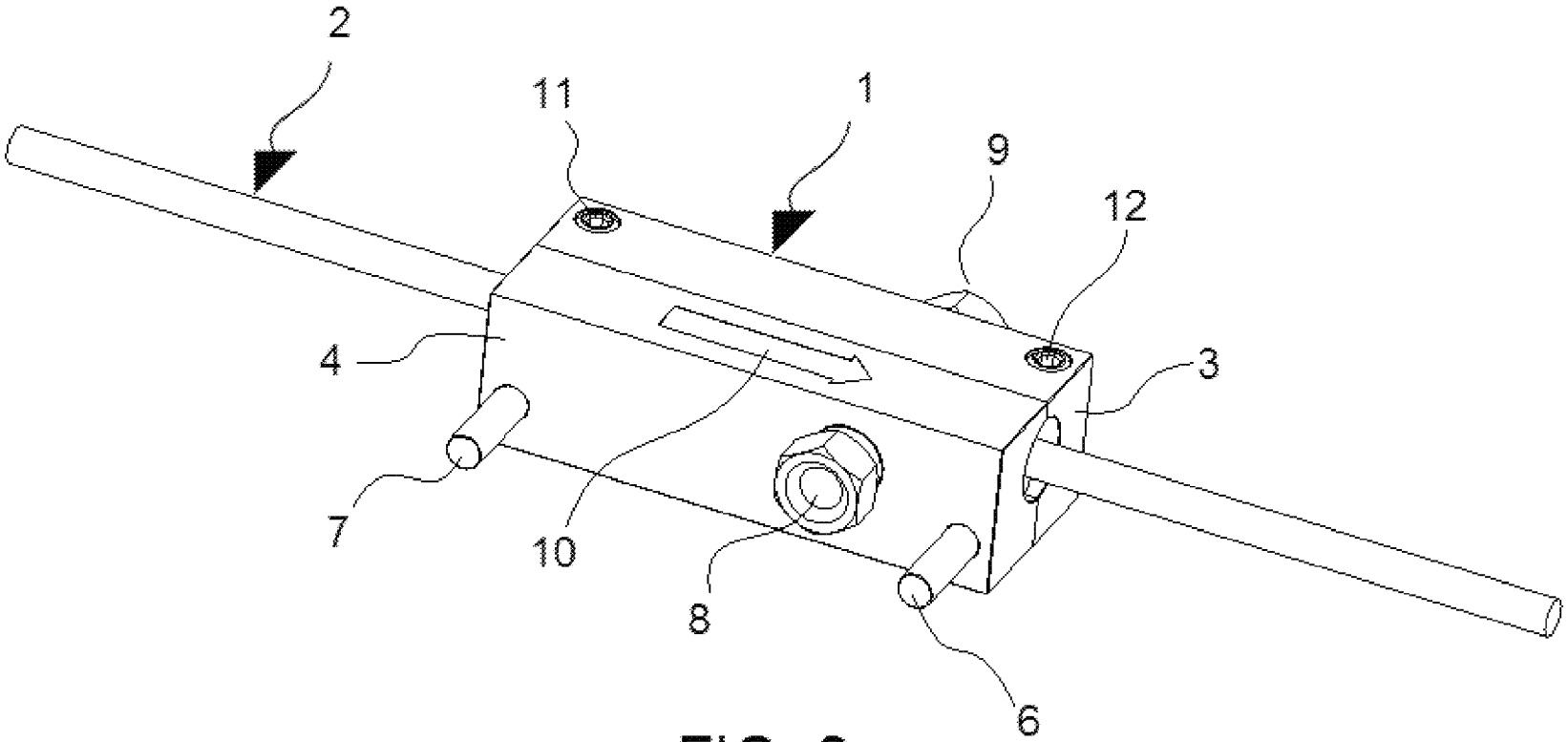
FIG. 2 is a perspective view of the air-wiping device closed upon receiving the elongated member.
Figure 3:
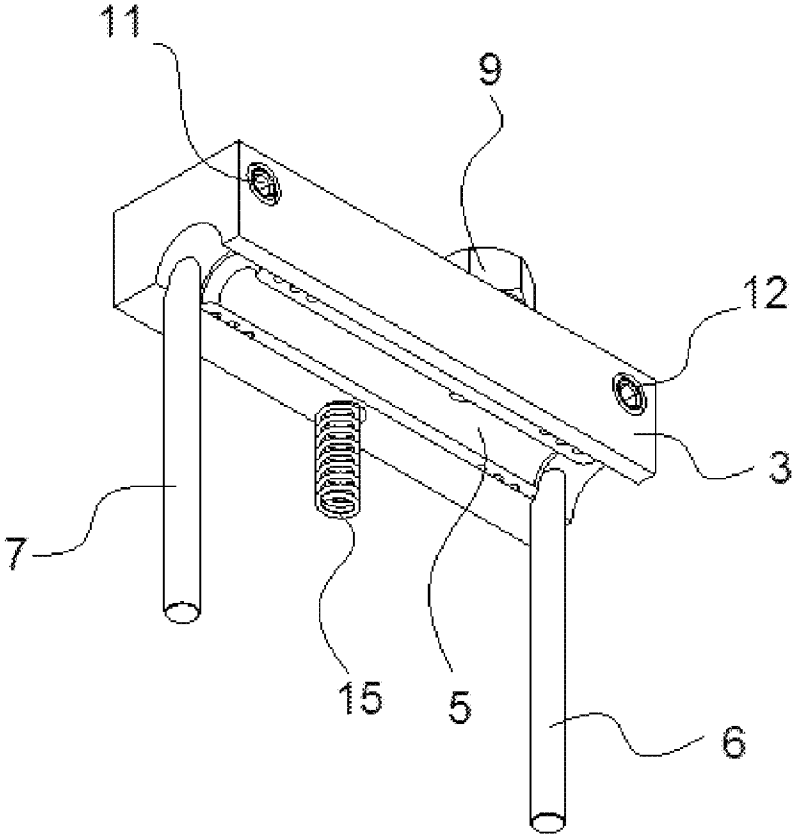
FIG. 3 is a bottom view of the left half of the air-wiping device.
Figure 4:
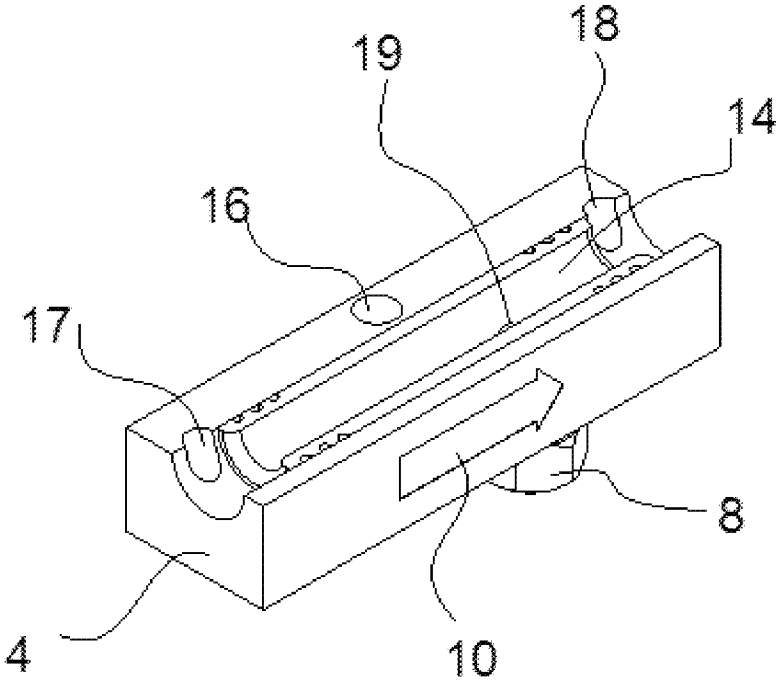
FIG. 4 is a top view of the right half of the air-wiping device.

As here embodied and depicted in FIGS. 1, 2, 3 and 4, there are shown an air-wiping device designated by the numerical one and an elongated product designated by the numerical two. One half of the metallic housing 3 (e.g. one of the two half bodies/pieces) and the inlaid half cylindrical wiping passage 5, being secured on a mounting lug (not shown) on the machine frame, are stationary, while the other half of the metallic housing 4 and the inlayed half cylindrical wiping passage 14 are free to move on a level plane by sliding on two precisely machined rails 7 and 6 respectively passing through holes 17 and 18 which are machined onto metallic housing 4 that insure a sliding motion without yawing or pitching which, in unison with the precisely ground mating surfaces of the two half metallic housings, provide the desired leak-proof hermetic sealing (explained more fully below) of the cylindrical wiping passage.

The compressed air is delivered by pipes(not shown) into the brass couplings 8 and 9, through metallic housings 3 and 4 respectively via orifices 13 and 19 into the cylindrical wiping passage, and directed tangentially and opposite to the direction of travel of the elongated product.

Since the cross sectional area of the orifices 13 and 19 is substantially smaller than that of the brass couplings 8 and 9, the air velocity increases while the air pressure decreases, obeying the Physics Equation of Continuity. A partial vacuum is created in the cylindrical wiping passage while the potential energy of the compressed air is converted into kinetic energy that dislodges the adhering particulates from the elongated member. The momentum of the kinetic energy is proportional to the magnitude of the partial vacuum. In accordance with this invention, the air-wiping device is hermetically sealed upon closing, eliminating any possible leakage away or into the cylindrical wiping passage, maintaining the highest possible efficiency without wasting energy.

Additionally, it should be appreciated that the present preferred embodiment of the invention, by using heat-resistant materials for all of its components including the pipes(not shown) that deliver the compressed air into the air-wiping device, is capable of being operated under elevated temperatures.

Although the preferred embodiments of present disclosure have been described herein, the above description is merely illustrative. The preferred embodiments disclosed will not limit the scope of the present disclosure. Further modification of the disclosure herein disclosed will occur to those skilled in the respective arts and all such modifications are deemed to be within the scope of the disclosure as defined by the appended claims.

What is claimed is:

1. An air-wiping device sliding to open and close in one plane to load and unload an elongated member, wherein the air-wiping device dislodges undesirable adhering particular matter from said elongated member by compressed air;

wherein the air-wiping device consists of two bodies and at least two rails, one of the bodies is stationary and the other one slides on the at least two rails, each of the bodies is inlayed with one-half piece of a cylindrical wiping passage with at least one orifice for directing the compressed air tangentially and opposite to the direction of the traversing elongated member;

wherein said rails are cylindrical and rotary, bearing against the traversing elongated member, relieving a major portion of the frictional abrasion, which otherwise exerts on the wiping passage.

2. The device of claim 1, wherein the air-wiping device comprises a rectangular housing and consists of two metallic bodies.

3. The device of claim 2, wherein the two metallic bodies are precisely machined, lapped, and hermetically sealed under a tension of a spring and an inward pressure of the environmental atmosphere when the device is closed under wiping, yet it will open readily to let pass knots carried by the elongated member.

* * * * *